US006405459B1

(12) United States Patent
Prevost et al.

(10) Patent No.: US 6,405,459 B1
(45) Date of Patent: Jun. 18, 2002

(54) BOWLING OVERSHOE

(75) Inventors: Robert Prevost, Las Vegas, NV (US); Stephen F. Borenstein, Laguna Niguel, CA (US)

(73) Assignee: Master Industries, Inc., Irvine, CA (US)

( * ) Notice: Subject to any disclaimer, the term of this patent is extended or adjusted under 35 U.S.C. 154(b) by 0 days.

(21) Appl. No.: 09/694,289

(22) Filed: Oct. 23, 2000

(51) Int. Cl.[7] ..... A43B 3/16; A43B 5/00; A43B 3/24; A43B 13/38; A43C 13/00

(52) U.S. Cl. ..... 36/130; 36/7.1 R; 36/15; 36/23; 36/100; 36/43

(58) Field of Search ..... 36/130, 7.1 R, 36/7.1 A, 7.3, 7.5, 15, 23, 73, 97, 19.5, 100, 101, 136, 137, 103, 43, 44, 45, 88, 93, 102, 8.3

(56) References Cited

U.S. PATENT DOCUMENTS

| | | | | | |
|---|---|---|---|---|---|
| 4,497 | A | * | 5/1846 | Vetter | 36/7.3 |
| 1,184,123 | A | | 5/1916 | Paul | |
| 1,395,958 | A | | 11/1921 | Hamilton | |
| 1,714,943 | A | * | 5/1929 | Brockman | 36/19.5 |
| 2,246,562 | A | | 6/1941 | Whitley | |
| 2,252,315 | A | * | 8/1941 | Doree | 36/97 |
| 2,307,699 | A | | 1/1943 | Moen | |
| 2,378,721 | A | | 6/1945 | Nichols | |
| 2,427,882 | A | | 9/1947 | Schulte | |
| 2,473,877 | A | * | 6/1949 | Goldstein | 36/137 |
| 2,640,283 | A | | 6/1953 | McCord | |
| 3,026,635 | A | * | 3/1962 | Slade | 36/7.3 |
| 3,027,661 | A | | 4/1962 | McCord | |
| 3,106,790 | A | | 10/1963 | Zimmon | |
| 3,308,562 | A | | 3/1967 | Zimmon | |
| 3,609,888 | A | | 10/1971 | Rickman | |
| 3,672,077 | A | | 6/1972 | Coles | |
| 4,120,103 | A | | 10/1978 | Colby | |
| 4,281,466 | A | | 8/1981 | Malone | |
| 4,301,604 | A | | 11/1981 | Hamiltion | |
| 4,351,120 | A | | 9/1982 | Dalebout | |
| 4,519,148 | A | | 5/1985 | Sisco | |
| 4,554,749 | A | | 11/1985 | Ostrander | |
| 4,704,810 | A | * | 11/1987 | Massengale | 36/130 |
| 4,712,319 | A | * | 12/1987 | Goria | 36/137 |
| RE33,018 | E | | 8/1989 | Ostrander | |
| 4,944,099 | A | * | 7/1990 | Davis | 36/97 |
| 4,974,344 | A | | 12/1990 | Ching | |
| 5,056,240 | A | | 10/1991 | Sherrill | |
| 5,176,624 | A | | 1/1993 | Kuehnreigh | |
| 5,410,821 | A | | 5/1995 | Hilgendorf | |
| 5,542,198 | A | * | 8/1996 | Famolare | 36/130 |
| 5,560,126 | A | | 10/1996 | Meschan et al. | |
| 5,611,156 | A | * | 3/1997 | Chiu | 36/137 |
| 5,638,614 | A | | 6/1997 | Hardy | |
| D388,592 | S | | 1/1998 | Minden | |
| 5,716,723 | A | | 2/1998 | Van Cleef et al. | |
| 5,727,334 | A | * | 3/1998 | Cougar | 36/15 |
| 5,813,145 | A | * | 9/1998 | Prober | 36/93 |
| 5,826,352 | A | | 10/1998 | Meschan et al. | |
| D405,243 | S | | 2/1999 | Shoemaker | |
| 5,956,868 | A | * | 9/1999 | Stevens et al. | 36/97 |
| 6,023,859 | A | | 2/2000 | Burke et al. | |

FOREIGN PATENT DOCUMENTS

| | | | | | |
|---|---|---|---|---|---|
| EP | 0510384 | A1 | | 10/1992 | |
| FR | 2598894 | | | 11/1987 | |
| FR | 2619490 | A | * | 2/1989 | 36/97 |
| GB | 10462 | | | 9/1913 | |
| GB | 101559 | | | 10/1916 | |
| GB | 139375 | | | 3/1920 | |
| GB | 666910 | A | * | 2/1952 | 36/19.5 |

(List continued on next page.)

*Primary Examiner*—Mickey Yu
*Assistant Examiner*—Anthony Stashick
(74) *Attorney, Agent, or Firm*—Knobbe, Martens, Olson & Bear, LLP

(57) ABSTRACT

A bowling overshoe includes an upper formed from a stretchable sheet material and two outsole portions attached independently of each other.

55 Claims, 7 Drawing Sheets

FOREIGN PATENT DOCUMENTS

| | | | | | |
|---|---|---|---|---|---|
| GB | 2178940 A | * | 2/1987 | ..... | 36/101 |
| GB | 2232057 A | | 5/1990 | | |
| JP | 405137604 A | * | 6/1993 | ..... | 36/137 |
| NL | 8202234 A | * | 1/1984 | ..... | 36/73 |

* cited by examiner

BOWLING OVERSHOE

BACKGROUND OF THE INVENTION

1. Field of the Invention

The present invention is directed to an overshoe designed to fit over conventional shoes, and in particular, an overshoe for replacing conventional rental shoes required by operators of bowling alleys facilities.

2. Description of the Related Art

As is well known, bowling is basically an indoor sport that utilizes expensive bowling surfaces which are usually formed of hardwood and a synthetic material or the like and includes an approach portion that is traveled on extensively by bowlers. Due to the expensive nature of these bowling alleys and the desirability to maintain the alleys in an immaculate condition and so as to minimize bowling differences between alleys, certain rules and/or regulations have been established by the operators of bowling facilities. In particular, most bowling facilities require that the users of the facilities wear a shoe which will not mark, damage, or cause undue wear to the bowling alleys, and in particular, the approach portions of the alleys.

In response to these requirements, some frequent bowlers have purchased shoes that are specifically designed for bowling. However, occasional bowlers, which constitute a significant portion of the market for bowling facilities, rely on the supply of rental shoes maintained by the operators of the bowling facility. Typically, the bowling facilities rent these shoes to any user who does not have proper shoes for bowling. As would be expected, this requires the owner of the bowling facility to maintain a large supply of these specialized shoes in various sizes and in men's and women's styles. As such, the casual bowler is almost sure to be forced to wear a shoe which has been worn previously by others. Such shoes, in many instances, do not fit as comfortably as the user's conventional shoes. Additionally, the bowling facility may have only a limited number of a particular size of bowling shoe, thus forcing some users to wear rental shoes that are too large or too small.

In order to minimize the spreading of any foot diseases and minimize the objections of the casual bowler in wearing shoes previously worn by others, the proprietors of bowling facilities sanitize the rental shoes between uses by different people. An antibacterial aerosol spray is typically used to sanitize such rental shoes.

In order to withstand the repeated use of these shoes by different users, such rental shoes are typically constructed with an all-leather upper and a thick outsole. This construction translates into a high cost for maintaining an adequate supply of rental shoes. Additionally, the antibacterial cleaner repeatedly applied to these shoes causes the shoes to deteriorate more quickly. Thus, bowling rental shoes deteriorate more quickly than a shoe which is not subjected to repeated applications of antibacterial cleaners.

In order to provide bowling facility operators with an alternative to maintaining a supply of conventional bowling shoes for rental purposes, several designs of bowling overshoes to be worn over a conventional shoe have been proposed. For example, U.S. Pat. No. 3,609,888 issued to Rickman discloses a bowling overshoe constructed from a toe cup portion and a heel cup portion, both of which are constructed of leather, and an elastic member connecting the toe cup and heel cup portions together. The toe and heel cup portions each include one adjustable strap so as to accommodate different shoe sizes. In particular, the heel cup portion includes a single strap arranged to extend over the vamp portion of a user's shoe and an adjustable toe strap which extends over the portion of a user's shoe covering the user's toes.

Recently, certain bowling facilities have begun to hold special events within the facility, referred to as "glow-bowling". A glow-bowling event is unique in that bowlers are allowed to bowl in partial darkness with music and light shows similar to that provided in a nightclub including "black lights" which cause florescent materials to emit light energy and thus appear to glow. Some bowlers have been known to wear florescent clothing during such events. For safety and other reasons, certain areas of the facility are lighted so that bowlers can safely walk through the facility. However, in some facilities, even the approach portion of the bowling lanes are left in darkness, illuminated with only black lights.

Despite the development of several alternatives to rental shoes, bowling facilities continue to maintain large supplies of conventional rental shoes for use by their patrons. Thus, a need exists for an improved bowling overshoe for replacing conventional overshoes.

SUMMARY OF THE INVENTION

One aspect of the present invention includes the realization that known alternatives for conventional bowling shoes can be inadequate. For example, as noted above, one known bowling overshoe is constructed of heel cup and toe cup portions, each having a single strap for tightening around a user's shoe. It has been found that such a design is perceived to be inadequate for safety and comfort reasons.

For example, in order for a user to safely install such an overshoe onto a conventional shoe, the straps must be sufficiently tightened to prevent the overshoe from slipping off the user's shoe, not only during bowling, but under any situation. In particular, a user wearing such an overshoe might accidentally slip or trip while wearing the overshoe, which is likely to subject the overshoe to higher loads than those transferred to the straps under normal use. Thus, the straps holding the overshoe to the user's conventional shoe must be tightened sufficiently to prevent the overshoe from slipping off if the user slips or trips.

Because the overshoe taught in U.S. Pat. No. 3,609,888 is attached only with one strap on each end, and since these straps need to be sufficiently tightened, as noted above, these straps can cause discomfort to the user by causing excessive pressure beneath the strap. For example, the uppers of conventional shoes can be made from a variety of materials. Such materials can include nylon, leather, vinyl, or a combination of any of these and other materials. A strap tightened around the outer periphery of such an upper can cause the upper to wrinkle, thus creating an uncomfortable protrusion within the user's conventional shoe. Such a protrusion can cause a blister during use.

Another drawback of the type of bowling shoe described in U.S. Pat. No. 3,609,888, is that since the heel cup and toe cup portions are made from a relatively inelastic material, e.g., leather, such an overshoe could not comfortably accommodate a broad range of shoe sizes. For example, FIG. 2 from U.S. Pat. No. 3,609,888 is reproduced herein as FIG. 1. As shown in FIG. 1, the bowling overshoe taught in U.S. Pat. No. 3,609,888 includes a heel cup portion 12 and a toe cup portion 14. The heel cup portion 12 includes a generally semicircular side wall 16 sewn to an insole 18 so as to correspond generally to the shape of a conventional shoe. However, the width 20 of the heel cup 12 limits the sizes of conventional shoes which the overshoe 10 can accommodate.

For example, if a conventional shoe placed within the overshoe 10 is too narrow, the heel cup portion 12 will not closely follow the outer contours of the conventional shoe, and thus, may not provide a stable connection between the overshoe 10 and the conventional shoe. Conversely, if the conventional shoe is too large, the heel of the conventional shoe might overlap and extend beyond the insole portion 18 and thus prevent the heel cup portion 12 from providing a tight fit with the conventional shoe. The toe cup portion 14 can experience similar problems.

In accordance with another aspect of the present invention, a bowling overshoe comprises an upper configured to substantially surround an upper of a conventional shoe and constructed of a stretchable material. The overshoe also includes a stretchable insole having a toe and heel area. A first outsole portion is connected to the toe area of the insole and a second outsole portion is connected to the heel area of the insole independently of the first outsole portion. By attaching the first and second outsole portions independently to the insole, and constructing the upper out of a stretchable material, the bowling overshoe according to the present aspect of the invention provides significant advantages.

For example, by constructing the bowling overshoe as noted above, the bowling overshoe can accommodate a greater number of shoe sizes with better comfort and a more secure attachment to a conventional shoe. By constructing the upper of a stretchable material and to substantially surround an upper of a conventional shoe, the upper can stretch and thus accommodate many different shoe shapes that a user may insert into the overshoe. For example, if a user's conventional shoe includes tassels, lights, running computers, or metal clips in place of conventional eyelets for receiving shoe laces, the stretchable upper can extend over these features and thus be tightened around the user's conventional shoe. As such, the present overshoe provides more evenly distributed pressure over the conventional shoe upper and thus provides a more stable and comfortable connection between the overshoe and a conventional shoe. Additionally, by attaching the outsole portions independently from one another, the insole of the overshoe can stretch in the longitudinal direction and thus accommodate various lengths of conventional shoes, corresponding to different shoe sizes. Additionally, due to the construction of the upper, the present overshoe can accommodate a number of shoe widths, which correspond to different shoe sizes, without causing wrinkles or slackened portions in the upper.

Preferably, the shoe upper and insole are formed from commercially available neoprene. Additionally, the outsole portions can be formed from commercially available waterproof leather. Thus, the cost of the raw materials for making such an overshoe are far less than the raw materials needed for making a conventional bowling rental shoe, which translates into savings for bowling facility proprietors.

According to yet another aspect of the present invention, a bowling overshoe comprises an upper made from a first resilient material having a first modulus of elasticity and an insole portion made from a second resilient material having a second modulus of elasticity. The second modulus of elasticity is less than the first modulus of elasticity. Additionally, first and second outsole portions are connected to the toe portion of the insole and heel portion of the insole, respectively. By constructing the insole from a material having a modulus of elasticity that is lower than the modulus of elasticity of the material forming the upper, the present overshoe provides several advantages.

For example, as the present overshoe is stretched over a conventional shoe, the upper, which is shaped similarly to a conventional shoe upper, stretches in length and width to accommodate a conventional shoe. However, the insole portion is connected to first and second outsole portions which are independent from each other. Thus, the portion of the insole that can stretch to accommodate different sizes of conventional shoes is limited to the portion of the insole extending between the first and second outsole portions. By constructing the insole portion of a material having a lower modulus of elasticity than the upper, the elongation of the insole portion is more consistent with the elongation of the upper.

In accordance with a further aspects of the present invention, an overshoe comprises a stretchable upper configured to receive an upper of a conventional shoe, a stretchable insole having heel and toe portions, and insole members fixed to the heel and toe portions so as to substantially prevent the heel and toe portions from stretching. Outsole members are bonded to the insole members. As such, the present overshoe provides several advantages.

For example, the technique for attaching conventional outsoles to conventional insoles, such as those used on rental bowling shoes, has long been known. This technique includes a first step of forming a groove along a periphery of the outer surface of a thick outsole. A specialized sewing machine is then used to sew the outsole to the insole, with the stitchings extending within the groove.

By fixing insole members to the heel and toe portions so as to substantially prevent stretching of the heel and toe portions, and by bonding the outsoles to the insoles, the present overshoe avoids the need for the forming a groove in an outsole in using a specialized sewing machine for sewing the outsole to the insole.

Preferably, the insoles are formed from a thin non-stretchable material such as, for example, but without limitation, commercially available nylon. As such, the insoles can be sewn to the outsoles with a conventional sewing machine.

In accordance with yet another aspect of a present invention, an overshoe comprises a stretchable upper configured to substantially surround an upper of a conventional shoe, and an outsole portion configured to be used for bowling. The upper includes at least one fluorescent portion on an outer surface thereof. By including at least fluorescent portion on the outer surface of the upper, the present invention provides several advantages.

For example, because certain bowling facility operators hold events during which visitors bowl in partial darkness, there is increased risk of injury during such an event. Additionally, many bowlers do not own specialized bowling shoes, and thus rely on the supply of rental shoes maintained by bowling facility operators. Thus, by including at least one fluorescent portion on the outer surface of the upper of the present overshoe, a significant number of the bowlers participating in a partial darkness event will have shoes with glowing portions. As such, bowlers are more visible to each other, which thereby reduces the risk of accident or injury during a partial darkness bowling event.

Preferably, the fluorescent portion comprises an ink applied to the stretchable upper. As such, bowling facility operators can choose to have customized messages written in the ink, thus providing additional advertising messages that are visible even during partial darkness bowling events.

Various features of the above noted aspects of the invention can also be interchanged, as will be readily apparent to those skilled in the art. In addition, further aspects, features, and advantages of the present invention will become apparent from the detailed description of the preferred embodiments which follow.

Figure 1:
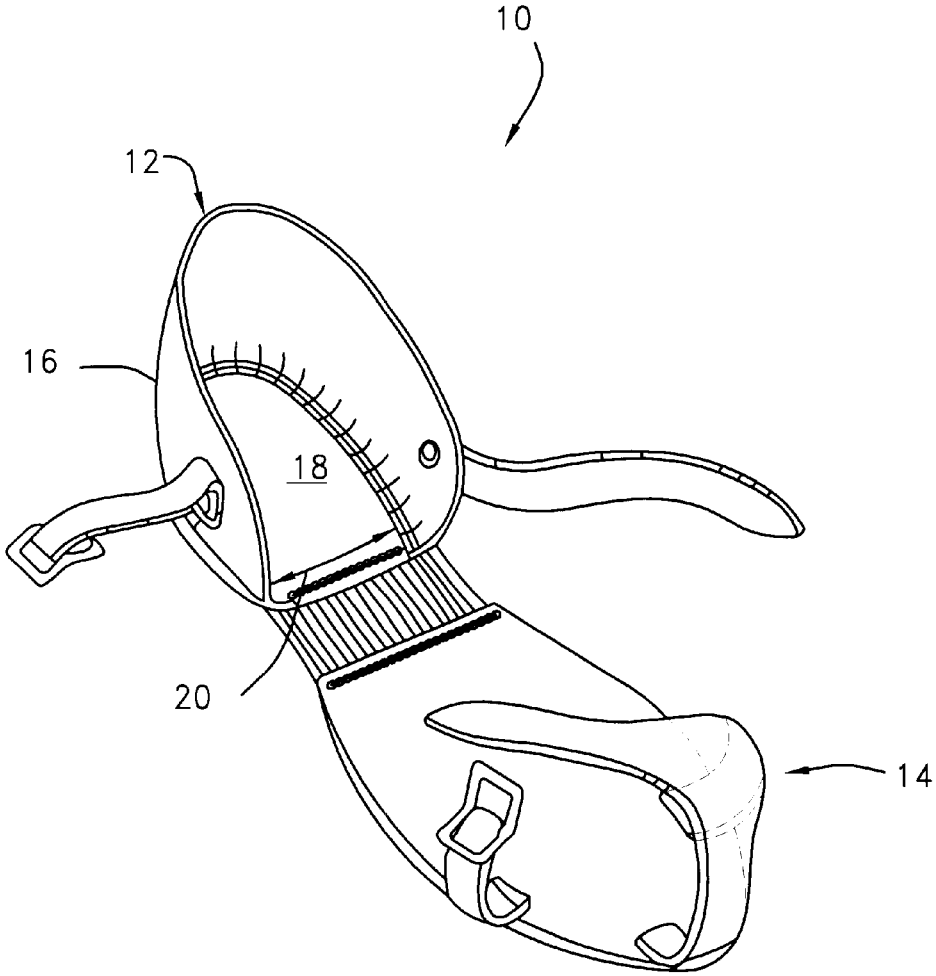
FIG. 1 Background Art
FIG. 1 is a top, front, and rightside perspective view of a known bowling overshoe.
Figure 2:
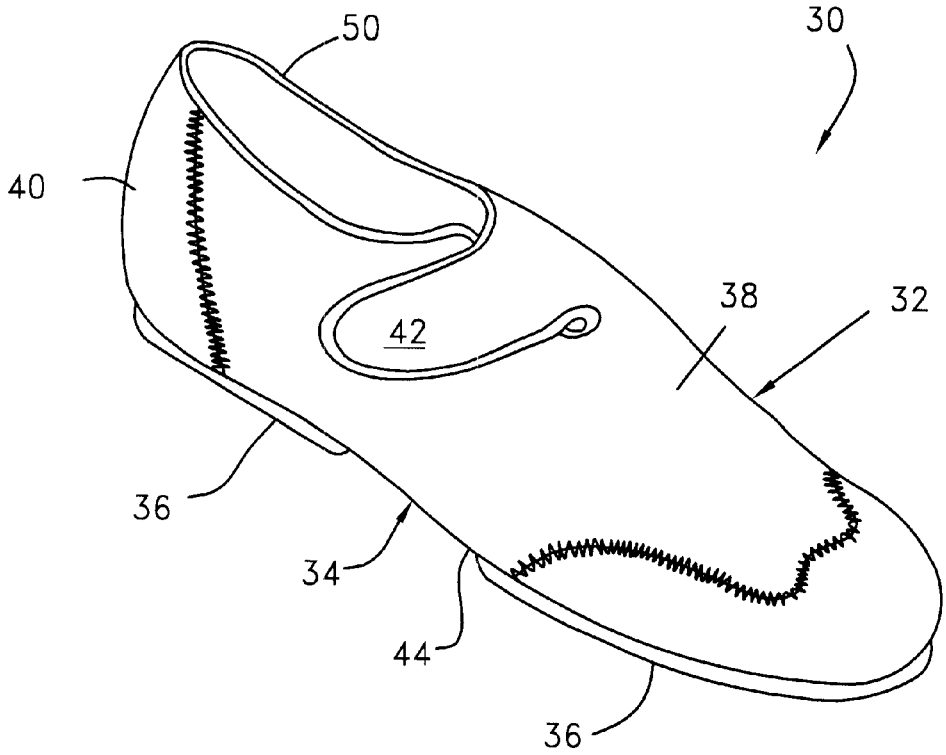
Figure 3:
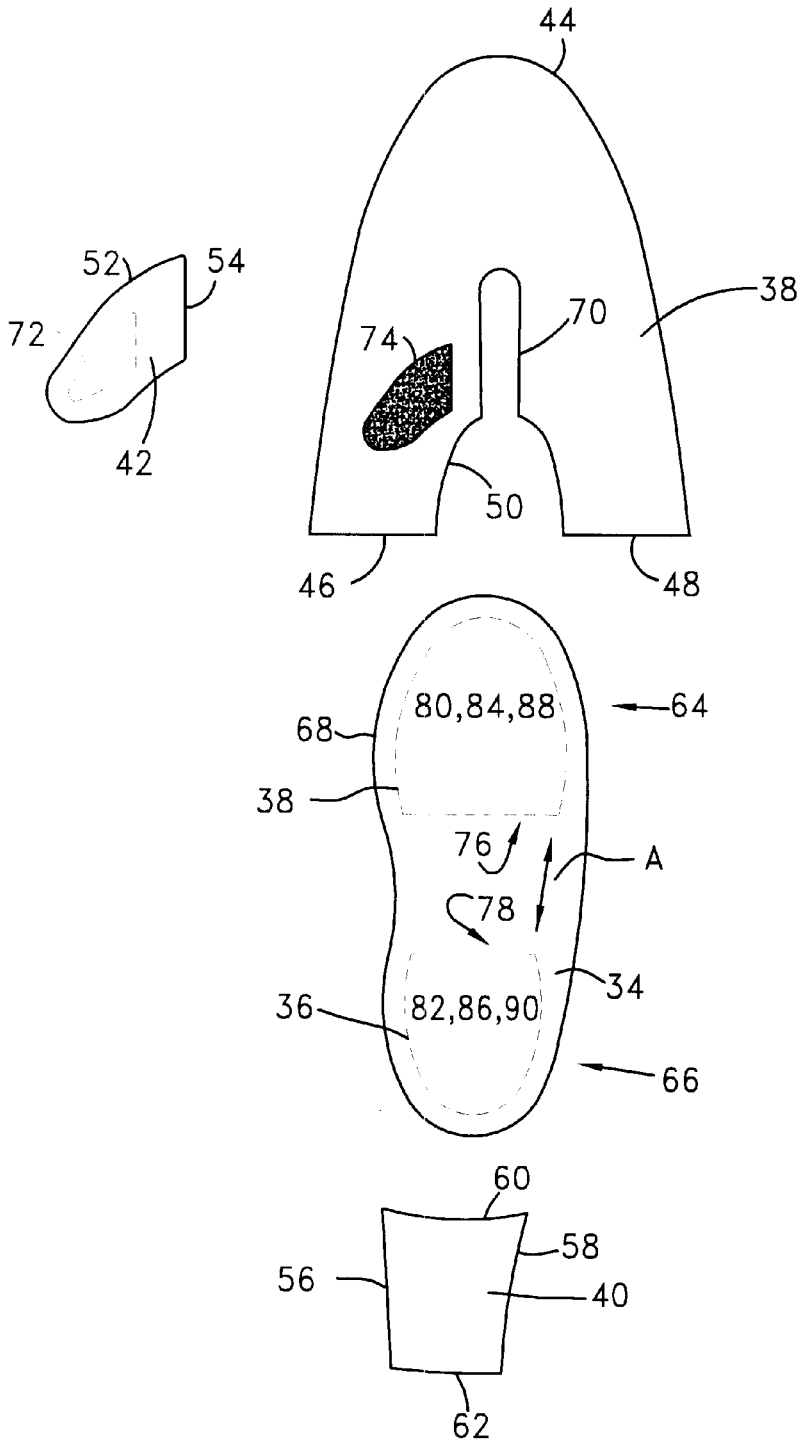
Figure 4:
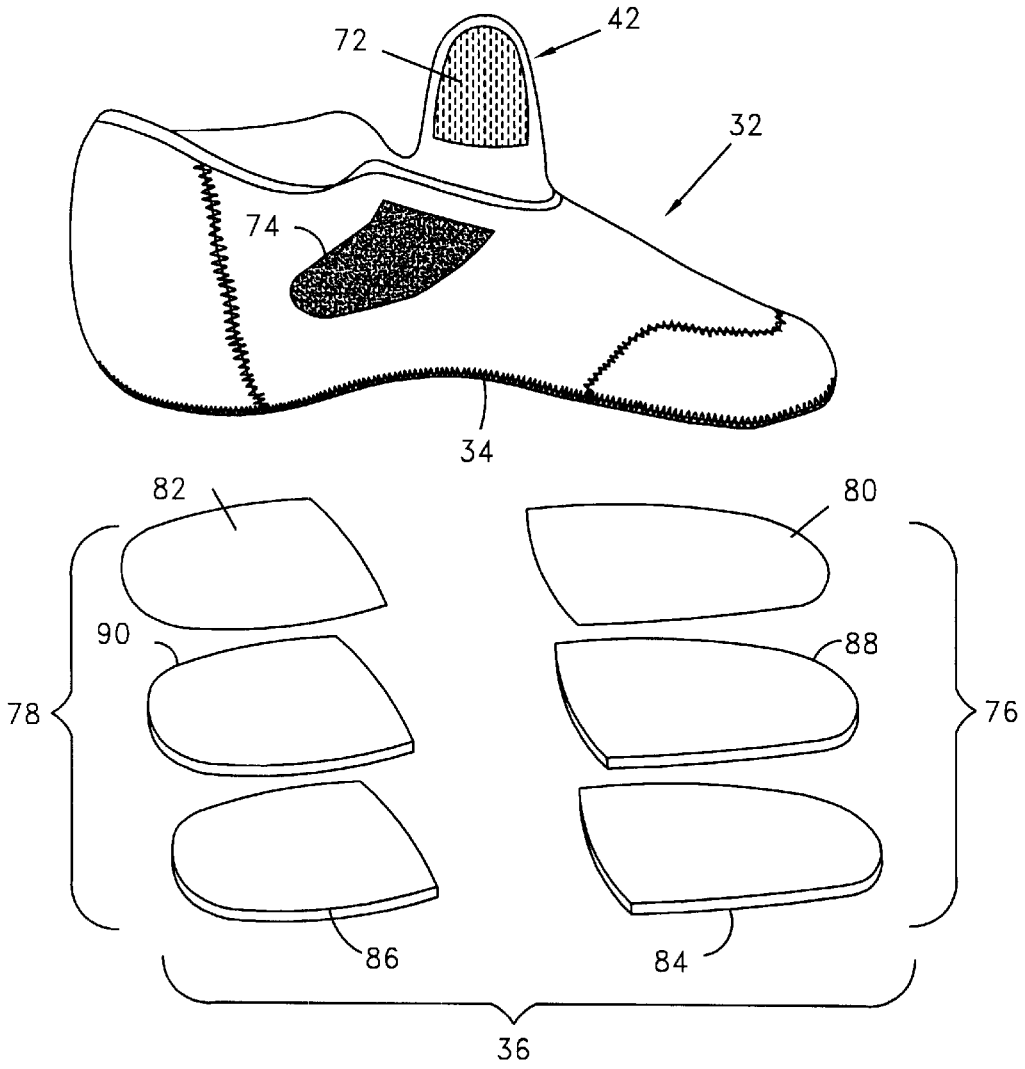
Figure 5:
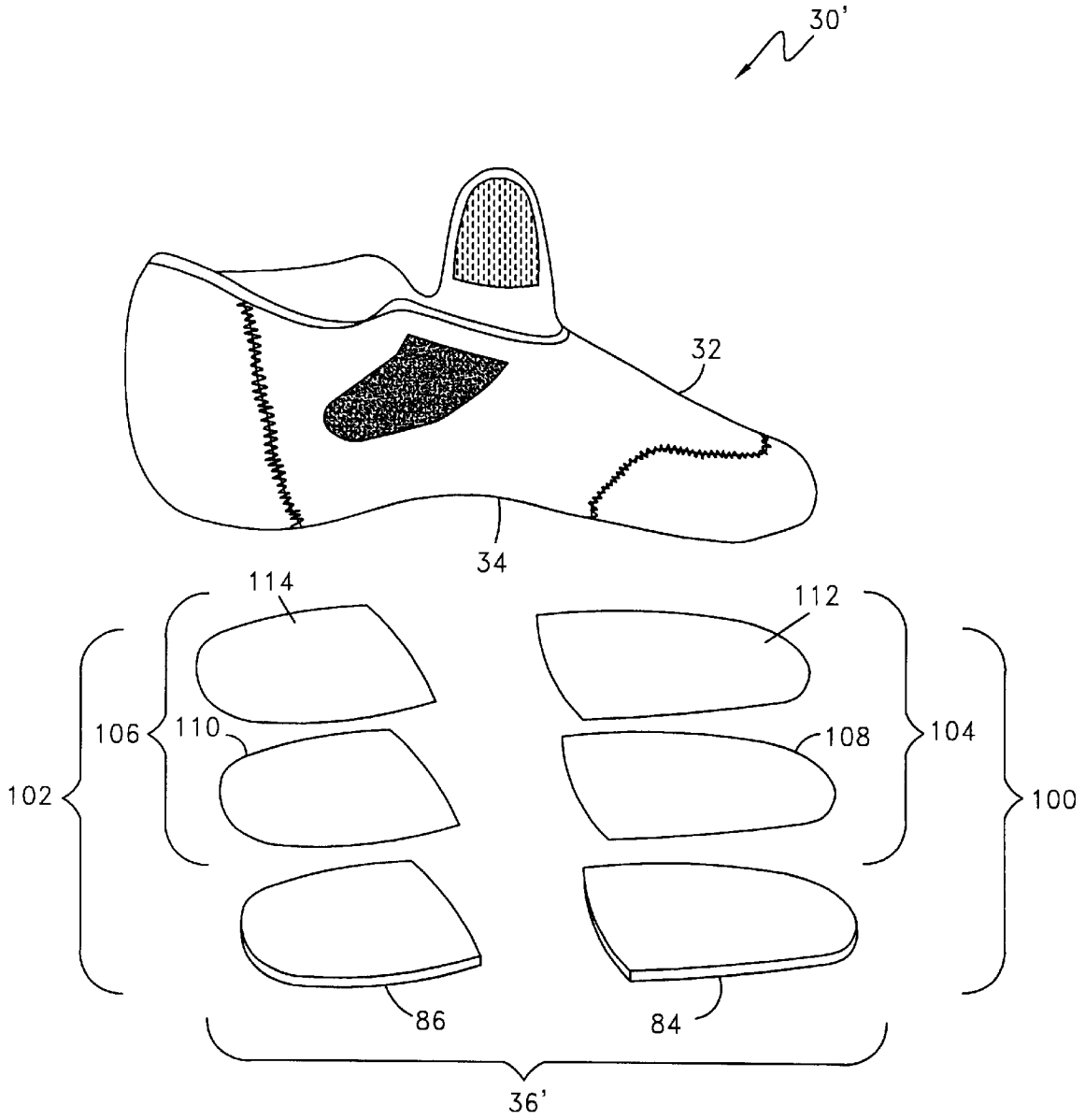
Figure 6:
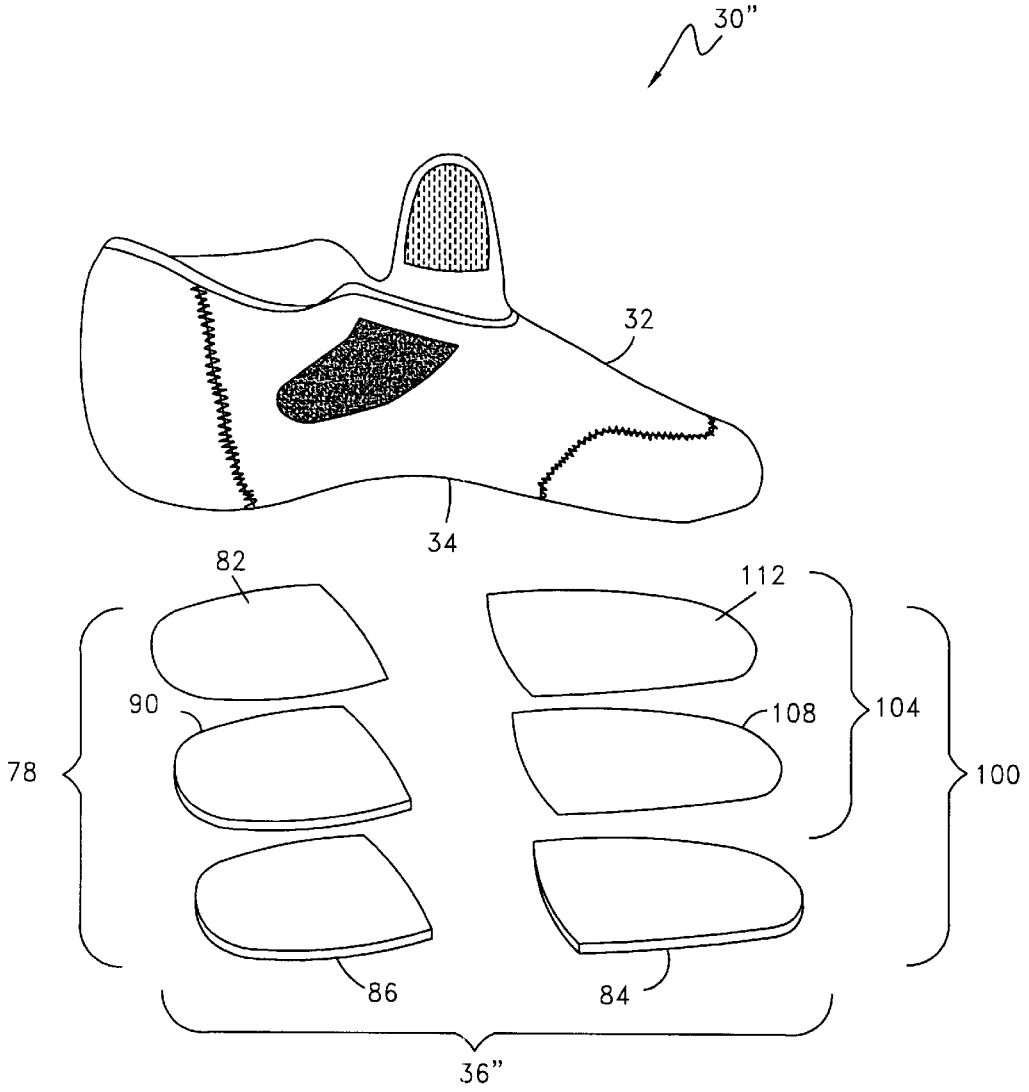
Figure 7:
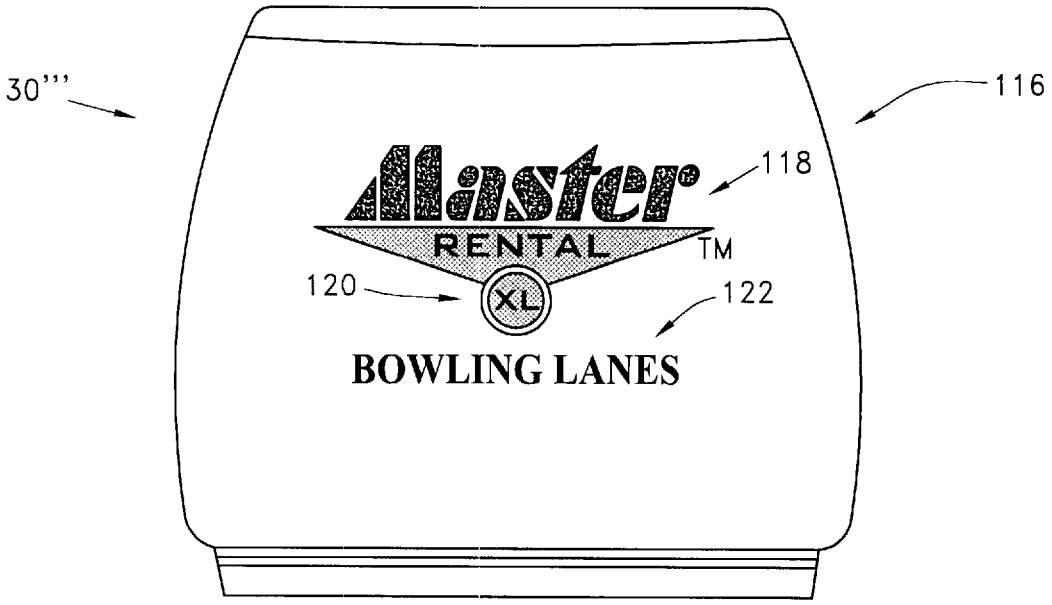

The features mentioned in the Summary of the Invention, as well as other features of the invention, will now be described with reference to the drawings of the preferred embodiments of the present bowling overshoe. The illustrated embodiments of the bowling overshoe are intended to illustrate, but not to limit, the invention. The drawings contain the following figures:

FIG. 2 is a front, top, and right side perspective view of a bowling overshoe constructed in accordance with a preferred embodiment of the present invention;

FIG. 3 is a top view of the upper and insole of the overshoe illustrated in FIG. 2, in a dissembled state;

FIG. 4 is a side elevational and exploded view of the overshoe illustrated in FIG. 2;

FIG. 5 is a modification of the overshoe illustrated in FIG. 4;

FIG. 6 is a further modification of the overshoe illustrated in FIG. 4; and FIG. 7 is a rear elevational view of an overshoe constructed in accordance with another embodiment of the invention.

DETAILED DESCRIPTION OF THE PREFERRED EMBODIMENT OF THE INVENTION

The present invention is directed to a bowling overshoe. In general, the bowling overshoe includes a stretchable upper, a stretchable insole, and an outsole divided into two portions. Those of skill in the art will appreciate that the invention has particular utility for bowling, but can also be used or adapted for use in a variety of other settings, for example, but without limitation, golf, boating, or other activities which requires specialized shoes.

With reference to FIGS. 2–4, an overshoe 30 constructed in accordance with one aspect of the present invention is illustrated therein. The overshoe 30 includes an upper 32, a midsole 34 and an outsole 36.

With reference to FIG. 3, the upper 32 and insole 34 of the overshoe 30 are illustrated in an exploded and disassembled state. In the illustrated embodiment, the upper 32 is comprised of a vamp portion 38, a heel portion 40 and a tensioner 42.

As shown in FIG. 3, the vamp portion 38 is generally U-shaped having a forward peripheral edge 44, trailing edges 46, 48 and an inner edge 50.

The tensioner 42 includes an outer peripheral edge 52 and a base edge 54. As shown in the lower portion of FIG. 3, the heel portion 40 includes lateral edges 56, 58, a base edge 60 and an upper edge 62.

The insole portion 34 includes a toe portion 64 and a heel portion 66. A peripheral edge 68 extends entirely around the periphery of the midsole of the insole 34.

Preferably, at least the vamp portion 38 and the insole portion 34 are formed of a resilient or stretchable material. For example, in the presently preferred embodiment, the upper 32 and the insole 34 are constructed from a neoprene rubber available under the trade name B FOAM from the Sheico Company, Taiwan.

When assembled, the trailing edges 46, 48 of the vamp portion 38 are connected to the lateral edges 56, 58 of the heel portion 40, respectively. For example, the edges 46, 48, 56, 58 can be attached with conventional sewing methods. As such, the vamp 38 and the heel portion 40 form the upper 32. Preferably, the base edge 54 of the tensioner 42 is attached to a tensioner connecting edge 70 formed on the vamp portion 38. As such, the tensioner 42 can be used to tighten and more securely attach the overshoe 30 to a conventional shoe, discussed in more detail below.

The forward peripheral edge 44 and the base edge 60 are attached to the peripheral edge 68 of the insole 34. As such, these components form the upper 32 and insole 34 as illustrated in FIGS. 2 and 4. The outsole portions 36 are preferably formed from a durable material, which is substantially non-stretchable, such as a commercially available rubber or waterproof leather, discussed in more detail below.

Preferably, the upper 32 and the insole 34 are sized so as to accommodate a range of conventional shoe sizes. It has been found that the upper 32 and the insole 34 can be sized such that the overshoe can accommodate five shoe size ranges. Thus, only four sizes of the overshoe 30 are needed to cover the range of rental shoe sizes typically maintained by a bowling facility operator. For example, the upper 32 and the insole 34 can be sized such that a first size of the overshoe 30 accommodates shoe sizes from 5½–7½ (including half-sizes), a second size of the overshoe 30 accommodates shoe sizes from 7½–9½ (including half-sizes), a third size of the overshoe 30 accommodates shoe sizes from 9½–11½ (including half-sizes), a fourth size of the overshoe 30 accommodates shoe sizes from 11½–13.

Preferably, the tensioner 42 includes a securing device such that the tensioner 42 can be stretched and fixed against the overshoe 30 so as to tighten the upper 32 around a conventional shoe. For example, the tensioner 42 can include a first portion 72 of a hook and loop fastener and a second portion 74 of a hook and loop fastener can be provided on the vamp portion 38. The first portion 72 can form the "hook" side of the hook and loop fastener and the second portion 74 can form the "loop" portion of the hook and loop fastener. Such a fastener is commercially available under the trade name Velcro™. It is to be understood that the hook portion 72 of the hook and loop fastener could be mounted to the vamp 38 with the loop portion 74 attached to the tensioner 42.

With the tensioner 42 constructed as such, a user can open the tensioner 42, as illustrated in FIG. 4, and slip a conventional shoe into the interior of the overshoe 30. Once disposed within the overshoe 30, the tensioner 42 can be pulled across the vamp portion 38 of the upper 32 and attached to the loop portion 74, as illustrated in FIG. 2, thereby generating a snug fit over a conventional shoe. As is apparent from the illustration of FIG. 2, a conventional shoe disposed within the overshoe 30 is substantially completely surrounded by the upper 32. Thus, the material forming the upper 32 can conform and apply a securing force against the conventional shoe of a user disposed therein. As such, the securing force is evenly distributed and provides a more stable and comfortable article of footwear for a user during athletic activities, such as bowling.

In a presently preferred embodiment, the upper 32 is constructed of a first material having a first modulus of elasticity and the insole is constructed of a second material having a second modulus of elasticity that is less than the first modulus of elasticity. As such, less tensile stress is required to stretch the insole 34 as compared to the tensile stress required to stretch the upper 32 an equal amount.

A preferred material for the insole member 34 is available under trade name L FOAM from the Sheico Company. The L FOAM material has a lower modulus of elasticity than the B FOAM material preferably used to form the upper 32. Although the precise moduli of elasticity of the B FOAM and L FOAM materials are not available, it is known that the B FOAM requires above 0.5 kg/cm$^2$ to produce a 60% elongation and above 1.3 kg/cm$^2$ to produce a 120% elongation. It is also known that the L FOAM requires above 0.4 kg/cm$^2$ to produce a 60% elongation and above 1.1 kg/cm$^2$ to produce a 120% elongation. Thus, one of ordinary skill in the art will recognize that the B FOAM material has a higher modulus of elasticity than that of the L FOAM material. Additionally, one of ordinary skill in the art will recognize that the particular moduli of elasticity of the B FOAM and L FOAM materials are not required to achieve the beneficial results noted above. Rather, it is apparent to one of ordinary skill in the art that there are numerous alternatives and possible combinations of materials that can be used for constructing the upper 32 and insole 34 in accordance with the invention.

By constructing the insole 34 from a material having a modulus of elasticity that is lower than the modulus of elasticity of the material forming the upper 32, the present overshoe provides several advantages. For example, when a user stretches the overshoe 30, having the upper 32 and insole 34 constructed as noted above, over a conventional shoe, substantially the entire upper 32 stretches in length and width to accommodate the conventional shoe. However, the insole 34 is connected to first and second outsoles 36 which are independent of each other. Thus, the portion of the insole 34 that can stretch is limited substantially to the portion of the insole 34 extending between the first and second outsole portions 36. By constructing the insole 34 of a material having a lower modulus of elasticity than that of the upper 32, the forces required to elongate the insole 34 are more consistent with those required to elongate upper 32.

The inner surface of the upper 32 is preferably flocked with a soft material. As such, a user's shoe inserted into the overshoe 30 is further protected from damage. In contrast, the outer surface of the upper 32 is preferably covered with a durable fabric. Typically, neoprene is commercially available with various coverings, for example, but without limitation, flocking and/or a durable fabric.

With reference to FIG. 4, a presently preferred construction of the outsole 36 is illustrated therein. As shown in FIG. 3, the outsole 36 comprises a first forward outsole portion 76 and second rearward outsole portion 78 which is attached to the insole 34 independently of the forward outsole portion 76. The outsole portions 76, 78 can be attached to the insole 34 with any known means.

In a presently preferred embodiment, the outsole portion 76, 78 are comprised of a midsole member 80, 82 and an outsole member 84, 86, respectively. In this mode, the midsole members 80, 82 are preferably formed of a non-stretchable sheet material such as polyvinyl, polyester, PVC resin, or nylon fabric. A presently preferred material is commercially available under the trade name Imperial 600 Black Vinyl from the NASSIMI CORPORATION.

The midsole members 80, 82 are fixed to the insole portion 34 at the toe area 64 and the heel area 66, respectively. The midsole members 80, 82 can be attached to the insole member 34 with any known means. Preferably, the midsole members 80, 82 are sewn to the insole member 34. As such, the midsole members 80, 82 substantially prevent the toe and heel area 64, 66 of the midsole 34 from stretching. Thus, stretching of the insole 34 is substantially limited to a gap A between the toe area 64 and the heel area 66.

In this mode, the outsole members 84, 86 are preferably attached to the midsole members 80, 82 with an adhesive layer 88, 90. A preferred adhesive is available under the commercial name Low Fogging Adhesive Transfer Tape, Item No. 6038PC, from the 3M CORPORATION, 3M BONDING SYSTEMS DIVISION. Another preferred adhesive is available under the trade name SAR 36 from KENDA FARBEN, S.p.A., Italy. However, any adhesive can be used.

By bonding the outsole members 84, 86 to the midsole members 80, 82, with the adhesive layers 88, 90, the present overshoe 30 does not require expensive labor intensive techniques and machinery conventionally used for sewing an outsole to the insole of a shoe. For example, a commonly used technique for attaching a thick outsole to an insole of a conventional shoe is to first form a groove along a periphery of an outer surface of the outsole. A specialized sewing machine is then used to sew the outsole to the insole. However, by bonding the outsole members 84, 86 to the midsole members 80, 82, a specialized sewing machine and the step of forming a groove in the outsole is not required.

Additionally, by sewing the midsole members 80, 82, which are preferably made from a thin sheet-like substantially non-stretchable material, so as to prevent stretching of the insole 34 in the toe and heel areas 64, 66, the adhesive layers 88, 90 are not subjected to repeated fatigue generating stretching which can cause failure of the adhesive layers 88, 90.

In the presently preferred embodiment, the outsole members 84, 86 are made from a durable waterproof material such as leather. Such a leather is commercially available under the trade name Frisco Dry Black Waterproof Split Leather from the BLACK HAWK LEATHER COMPANY. Preferably, the outsole members 84, 86 are between 1.8 and 2.2 mm in thickness.

As noted above, where substantially non-stretchable outsole portions, such as outsole portions 76, 78, are independently attached to the insole 34, the elongation of the insole 34 is substantially limited to the gap A therebetween. In contrast, when the overshoe 30 is stretched in length, the elongation of the upper 32 is distributed over substantially the entire length of the upper 32. Thus, if the upper 32 is elongated by, e.g., 10%, the portion of the insole 34 lying in the gap A may be elongated by substantially more that 10%. Therefore, by constructing the insole 34 of a material having a modulus of elasticity that is less than that of the upper 32, the forces required to elongate the upper 32 are more consistent with the forces required to elongate the insole 34.

With reference to FIG. 5, a modification of the outsole portions 76, 78 shown in FIG. 4 is illustrated therein. Similar to the overshoe 30 illustrated in FIG. 4, the overshoe 30' illustrated in FIG. 5 includes a first forward outsole portion 100 disposed generally beneath the toe area 64 of the insole 34 and a second rearward outsole portion 102 disposed generally beneath the heel portion 66 of the insole 34. Together, the outsole portions 100, 102 form the outsole 36'.

In the present mode, the outsole portions 100, 102 include releasably engageable portions 104, 106. Preferably, the releasably engageable portions 104, 106 are formed from hook and loop assemblies. In this mode, the releasably engageable portions 104, 106 include a hook portion 108, 110 and loop portions 112, 114 respectively. The loop portions 112, 114 are fixed.to the insole 34 at the toe portions 64 and heel portions 66, respectively. The loop portions 112, 114 can be fixed, as noted above, in any known manner. Preferably, the loop portions 112, 114 are sewn to the insole 34. As known in the art, hook or loop portions of a hook and loop fastener can be sewn with conventional multipurpose sewing machines. One of ordinary skill in the art will appreciate that, alternatively, the hook portions 108, 110 can be attached to the insole 34 and the loop portions 112, 114 can be bonded to the outsole members 84, 86.

In this mode, the hook portions 108, 110 are bonded to the outsole members 84, 86, respectively. As such, the outsole members 84, 86 are releasably engageable with the insole 34. Thus, a user can reorient the outsole portions 100, 102 to achieve a comfortable fit when using the overshoe 30' with a conventional shoe.

With reference to FIG. 6, a further modification of the overshoe 30 is illustrated therein. As shown in FIG. 6, the overshoe 30" includes an outsole 36" comprised of the first forward outsole portion 100 illustrated in FIG. 5 and the second rearward outsole portion 78 illustrated in FIG. 4. With this construction, the heel outsole member 86 is permanently affixed to the insole 34 while the toe outsole member 84 is releasably engageable with the insole 34. As such, a user can replace the outsole member 84 within an outsole member having a more slippery lower surface so as to change the behavior of the overshoe 30" when bowling on a particular surface.

For example, it has been known that more advanced bowlers slide on the ball of their foot which is opposite the hand with which they throw a bowling ball. Thus, if a user wishes to change the behavior of a particular overshoe with respect to a particular bowling surface, the releasably engageable portion 104 allows a user to replace the forward outsole member 84 within another having the desired lower surface.

With reference to FIG. 7, the overshoe 30'" constructed in accordance with another embodiment of the present invention is illustrated therein. The overshoe 30'" shown in FIG. 7 can be constructed in accordance with any of the overshoes 30, 30', 30" disclosed above with reference to the embodiments of FIGS. 2–6, except as noted below.

The overshoe 30'" includes at least one florescent or "glow in the dark" portion 116 disposed on an outer surface of the upper 32. In the illustrated embodiment, the florescent portion 116 is disposed on the heel portion so as to visible when a user is wearing the overshoe 30'". Preferably, the florescent portion 116 includes indicia, for example, but without limitation, a manufacturer's identification 118, a size identification 120, and a bowling facility identification 122. In the presently preferred embodiment, all of the identifications 118, 120, 122 are part of the florescent portion 116. However, the florescent portion 116 can include any number of the identifications 118, 120, 122, or any other indicia, with the remaining identifications or indicia being comprised of non-florescent material.

The florescent portion 116 can be comprised of any known florescent materials. A presently preferred florescent material is commercially available under the trade name Plastasol. Plastasol is available as a wet ink that can be applied to fabrics and other surfaces. In a lighted environment, Plastasol appears as normal image. However, when moved into an area lighted with what is commonly referred to as a "black light," Plastasol emits light. As such, Plastasol can be applied to any portion of the upper 32. For example, further indicia (not shown) can be disposed on the tensioner 42.

By including at least one florescent portion 116 on the outer surface of the upper 32, bowling facility operators can maintain a supply of rental overshoes less expensively than maintaining a supply of conventional bowling rental shoes, while providing additional safety during events in which visitors bowl in partial darkness. Additionally, bowling facility operators can choose to have customized messages incorporated into the florescent portion 116, thus providing additional advertising space that is visible to users even during partial darkness bowling events.

Although the foregoing invention has been described in terms of certain preferred embodiments, other embodiments will become apparent to those of ordinary skill in the art in view of the disclosure herein. Furthermore, the skilled artisan will recognize the interchangeability of various features of one embodiment to another embodiment. Accordingly, the present invention is not intended to be limited by the recitation of preferred embodiments, but is intended to be defined solely by reference to the appended claims.

What is claimed is:

1. A bowling overshoe comprising:

an upper having a toe portion and a heel portion and being constructed of a stretchable material extending from the toe portion to the heel portion, the upper being configured to substantially surround an upper of a conventional shoe and to stretch, in at least a width direction, over a range of at least five half sizes of conventional shoes;

a stretchable insole having a toe area and a heel area;

a first outsole portion connected to the toe area of the insole; and a second outsole portion connected to the heel area of the insole, independently of the first outsole portion.

2. An overshoe according to claim 1, wherein the first and second outsole portions are releaseably engageable with the insole.

3. An overshoe according to claim 1, wherein the upper is comprised of neoprene.

4. An overshoe according to claim 1 additionally comprising a tensioner.

5. An overshoe according to claim 1 additionally comprising first and second non stretchable midsole members fixed to the toe and heel area of the insole, respectively.

6. An overshoe according to claim 5, wherein the first and second outsole members are bonded to the first and second midsole members, respectively.

7. An overshoe according to claim 1, wherein the upper is comprised of a material having a first modulus elasticity, and the insole is comprised of the material having a second modulus elasticity that is less than the first modulus of elasticity.

8. An overshoe according to claim 1 additionally comprising a hook and loop type fastener connecting the first outsole portion with the toe area.

9. An overshoe according to claim 8, wherein the second outsole portion is connected to the heel area with adhesive.

10. A bowling overshoe comprising:

an upper comprising a first resilient material having a first modulus of elasticity, the first modulus being sufficiently low to allow the upper to be stretched, at least in a width direction, over a range of at least five half sizes of conventional shoes;

an insole comprising a second resilient material, the second resilient material having a second modulus of elasticity less than the first modulus of elasticity, the insole having a toe portion and a heel portion;

a first outsole portion attached to the toe portion of the insole; and a second outsole portion attached to the heel portion of the insole, independently from the first outsole portion.

11. An overshoe according to claim 10 additionally comprising a tensioner configured to adjust a tension in the upper.

12. An overshoe according to claim 10, wherein the first and second outsole portions are releaseably engageable from the insole.

13. An overshoe according to claim 10 additionally comprising first and second substantially non stretchable midsole members attached to the toe portion and heel portion of the insole, respectively.

14. An overshoe according to claim 13, wherein the first and second outsole portions are connected to the first and second midsole portions, respectively.

15. An overshoe according to claim 10, wherein the first outsole portion is releaseably engageable with the toe area of the insole and the second outsole portion is permanently affixed to the heel area of the insole.

16. An overshoe according to claim 15 additionally comprising a hook and loop fastener configured to releaseably engage the first outsole portion to the toe area.

17. An overshoe according to claim 15, wherein the second outsole portion is bonded to the heel area.

18. An overshoe according to claim 17 additionally comprising a substantially non-stretchable midsole member disposed between the second outsole and the heel area.

19. A bowling overshoe comprising:

a stretchable upper configured to substantially surround an upper of a conventional shoe, the upper being sufficiently stretchable to stretch over a range of at least five half sizes of conventional shoes;

a stretchable insole having a toe area and a heel area;

a first midsole member being substantially non stretchable and fixed to at least one of the toe area and the heel area of the insole; and a first outsole member bonded to the first midsole member.

20. An overshoe according to claim 19, wherein the first outsole member is bonded to the first midsole member with an adhesive.

21. An overshoe according to claim 19 additionally comprising a tensioner configured to adjust a tension in the upper.

22. An overshoe according to claim 19, wherein the first midsole member is fixed to the toe portion of the insole, additionally comprising a second midsole member being substantially non stretchable and fixed the heel area of the insole.

23. An overshoe according to claim 22 additionally comprising a second outsole member bonded to the second midsole member.

24. An overshoe according to claim 19 additionally comprising a second outsole connected to the insole independently of the first outsole.

25. An overshoe according to claim 19, wherein the first midsole member is fixed to the heel portion of the insole, additionally comprising a second outsole member being releaseably engageable with the toe area of the insole.

26. An overshoe according to claim 25 additionally comprising a hook and loop fastener configured to connect the second outsole member with the toe area of the insole in a releaseably engageable manner.

27. An overshoe according to claim 1 additionally comprising at least one fluorescent portion on an outer surface of the upper.

28. An overshoe according to claim 27, wherein the outsole comprises a non-marking material appropriate for bowling.

29. An overshoe according to claim 27, wherein the first and second outsole members are disposed so as to define a gap therebetween.

30. An overshoe according to claim 27, wherein the fluorescent portion comprises indicia including a name of the bowling facility.

31. An overshoe according to claim 27 additionally comprising a tensioner configured to adjust a tension in the upper, the fluorescent portion being disposed on the tensioner.

32. An overshoe according to claim 27, wherein the fluorescent portion is configured so as to be visible during a partial darkness bowling event.

33. An overshoe according to claim 27, wherein the first outsole is releaseably engageable with the toe area and the second outsole member is bonded to the heel area.

34. An overshoe according to claim 33 additionally comprising a substantially non-stretchable midsole member fixed to the heel area, the second outsole member being bonded to the midsole member.

35. An overshoe comprising:

an upper having a toe portion and a heel portion and being constructed of a stretchable material extending from the toe portion to the heel portion, the upper being configured to substantially surround an upper of a conventional shoe, the stretchable material having a modulus of elasticity that is less than a modulus of elasticity of leather in both width-wise and length-wise directions relative to the upper;

a stretchable insole having a toe area and a heel area;

a first outsole portion connected to the toe area of the insole; and a second outsole portion connected to the heel area of the insole, independently of the first outsole portion.

36. An overshoe according to claim 35, wherein the first and second outsole portions are releaseably engageable with the insole.

37. An overshoe according to claim 35 additionally comprising first and second non stretchable midsole members fixed to the toe and heel area of the insole, respectively.

38. An overshoe according to claim 37, wherein the first and second outsole members are bonded to the first and second midsole members, respectively.

39. An overshoe according to claim 35, wherein the upper is comprised of a material having a first modulus elasticity, and the insole is comprised of the material having a second modulus elasticity that is less than the first modulus of elasticity.

40. An overshoe according to claim 35 additionally comprising a hook and loop type fastener connecting the first outsole portion with the toe area.

41. An overshoe comprising:

an upper having a toe portion and a heel portion, the upper comprising a first resilient material having a first modulus of elasticity, that is less than a modulus of elasticity of leather in both the width-wise direction and length-wise direction relative to the upper; an insole comprising a second resilient material, the second resilient material having a second of modulus elasticity less than the first modulus of elasticity, the insole having a toe portion and a heel portion;

a first outsole portion attached to the toe portion of the insole; and a second outsole portion attached to the heel portion of the insole, independently from the first outsole portion.

42. An overshoe according to claim 41, wherein the first and second outsole portions are releaseably engageable from the insole.

43. An overshoe according to claim 41 additionally comprising first and second substantially non stretchable midsole members attached to the toe portion and heel portion of the insole, respectively.

44. An overshoe according to claim 43, wherein the first and second outsole portions are connected to the first and second midsole portions, respectively.

45. An overshoe according to claim 41, wherein the first outsole portion is releaseably engageable with the toe area of the insole and the second outsole portion is permanently affixed to the heel area of the insole.

46. An overshoe according to claim 45 additionally comprising a hook and loop fastener configured to releaseably engage the first outsole portion to the toe area.

47. An overshoe according to claim 45, wherein the second outsole portion is bonded to,the heel area.

48. An overshoe according to claim 47 additionally comprising a substantially non-stretchable midsole member disposed between the second outsole and the heel area.

49. An overshoe comprising:

a stretchable upper configured to substantially surround an upper of a conventional shoe, the upper being comprised of a material having a modulus of elasticity that is less than a modulus of elasticity of leather in both width-wise and length-wise directions relative to the upper;

a stretchable insole having a toe area and a heel area;

a first midsole member being substantially non stretchable and fixed to at least one of the toe area and the heel area of the insole; and a first outsole member bonded to the first midsole member.

50. An overshoe according to claim 49, wherein the first outsole member is bonded to the first midsole member with an adhesive.

51. An overshoe according to claim 49, wherein the first midsole member is fixed to the toe area of the insole, additionally comprising a second midsole member being substantially non stretchable and fixed to the heel area of the insole.

52. An overshoe according to claim 51 additionally comprising a second outsole member bonded to the second midsole member.

53. An overshoe according to claim 49, wherein the first midsole member is fixed to the heel portion of the insole, additionally comprising a second outsole member being releaseably engageable with the toe area of the insole.

54. An overshoe according to claim 53 additionally comprising a hook and loop fastener configured to connect the second outsole member with the toe area of the insole in a releaseably engageable manner.

55. An overshoe according to claim 49 additionally comprising at least one fluorescent portion on an outer surface of the upper.

* * * * *